US009629438B2

(12) United States Patent
Bruder

(10) Patent No.: US 9,629,438 B2
(45) Date of Patent: Apr. 25, 2017

(54) COSMETIC DISPENSER

(75) Inventor: Thomas Bruder, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 218 days.

(21) Appl. No.: 14/111,671

(22) PCT Filed: Apr. 12, 2012

(86) PCT No.: PCT/EP2012/056715

§ 371 (c)(1),
(2), (4) Date: Nov. 5, 2013

(87) PCT Pub. No.: WO2012/140161

PCT Pub. Date: Oct. 18, 2012

(65) Prior Publication Data

US 2014/0050515 A1 Feb. 20, 2014

(30) Foreign Application Priority Data

Apr. 14, 2011 (DE) ..... 10 2011 007 405

(51) Int. Cl.
*B05B 11/04* (2006.01)
*A45D 34/04* (2006.01)
(Continued)

(52) U.S. Cl.
CPC ..... *A45D 40/26* (2013.01); *A45D 34/04* (2013.01); *A45D 2200/056* (2013.01)

(58) Field of Classification Search
CPC .... A45D 34/04; A45D 40/26; A46B 11/0041; B65D 37/00
(Continued)

(56) References Cited

U.S. PATENT DOCUMENTS 2,442,503 A * 6/1948 Melnikoff ..... A45D 40/04 132/320
2,715,236 A * 8/1955 Tereno ..... A45D 34/042 222/207
(Continued)

FOREIGN PATENT DOCUMENTS

DE 29 17 543 11/1979
EP 0 316 007 A2 5/1989
(Continued)

OTHER PUBLICATIONS

English translation of Office Action of Japanese Patent Office issued in Application No. 2014-504329 mailed Sep. 15, 2015 (3 pages).
(Continued)

*Primary Examiner* — Mark A Laurenzi
*Assistant Examiner* — Thomas M Abebe
(74) *Attorney, Agent, or Firm* — Flynn, Thiel, Boutell & Tanis, P.C.

(57) ABSTRACT

A pen-type cosmetic dispenser for discharging a cosmetic medium, including an elongate housing extending in a main direction of extent, a discharge opening at an end face of the housing, a liquid reservoir arranged inside the housing, and a pumping device arranged inside the housing, which pumping device can be actuated by an actuating handle arranged on a lateral surface of the housing. The pumping device has a pump chamber, which is connected to the liquid reservoir on an inlet side and to the discharge opening on an outlet side.
The pump chamber is delimited at least in sections by a wall which is flexible in shape, wherein the exterior surface of the wall forms the actuating handle.

17 Claims, 2 Drawing Sheets

(51) Int. Cl.

| | |
|---|---|
| ***B05B 11/00*** | (2006.01) |
| ***A46B 11/00*** | (2006.01) |
| ***B65D 47/18*** | (2006.01) |
| ***A45D 40/26*** | (2006.01) |

(58) Field of Classification Search
USPC ..... 401/186, 88
See application file for complete search history.

(56) References Cited

U.S. PATENT DOCUMENTS 2,743,042 A * 4/1956 Burgin ..... A46B 11/0055 222/191
2,761,833 A * 9/1956 Ward ..... B01J 47/002 210/136
2,804,846 A * 9/1957 Rogers ..... B43K 5/1845 401/186
3,144,676 A * 8/1964 La Mura ..... A46B 7/023 222/442
3,864,047 A * 2/1975 Sherrod ..... A46B 11/0058 132/308
3,903,888 A * 9/1975 Buelow ..... A46B 11/0041 222/187
4,615,635 A * 10/1986 Kim ..... A46B 7/046 401/134
4,685,819 A * 8/1987 Endo ..... A46B 11/0058 401/151
4,971,470 A * 11/1990 Moeck ..... B05B 11/0005 222/383.1
5,918,995 A * 7/1999 Puurunen ..... A46B 11/0058 401/146
6,179,503 B1 * 1/2001 Taghavi-Khanghah A46B 11/0058 401/145
6,200,055 B1 * 3/2001 Fusaro, Jr. ..... A45D 34/042 401/151
6,241,412 B1 * 6/2001 Spies ..... A46B 11/002 206/532
6,745,781 B2 * 6/2004 Gueret ..... A45D 40/26 132/320
6,880,999 B2 * 4/2005 Biegel ..... A45D 34/04 401/174
D574,232 S * 8/2008 Py ..... D9/434
8,006,870 B2 * 8/2011 Stadelhofer ..... B05B 11/0067 222/207
8,007,193 B2 8/2011 Py et al.
8,132,695 B2 * 3/2012 Py ..... B65D 47/18 222/207
8,292,129 B2 * 10/2012 Stadelhofer ..... B05B 11/0027 222/182
8,342,765 B2 * 1/2013 Stenton ..... A61B 17/00491 222/213
8,511,323 B2 * 8/2013 Jimenez ..... A46B 11/0024 132/308
8,690,468 B2 4/2014 Py et al.
8,818,500 B2 * 8/2014 Duquet ..... A61N 5/0616 401/95
8,985,885 B2 * 3/2015 Kang ..... A45D 34/042 222/383.1
2004/0161292 A1 * 8/2004 Breidenbach ..... A45D 34/06 401/266
2006/0065677 A1 * 3/2006 Py ..... A45D 34/04 222/383.1
2006/0140708 A1 * 6/2006 Byun ..... A45D 34/042 401/270
2006/0263141 A1 * 11/2006 Wang ..... B05B 11/047 401/186
2010/0284726 A1 * 11/2010 Ottaviani ..... A46B 11/0041 401/187
2013/0017010 A1 * 1/2013 Liu ..... A45D 34/02 401/16
2014/0050515 A1 * 2/2014 Bruder ..... A45D 34/04 401/186
2015/0086259 A1 * 3/2015 Moreau ..... A45D 34/04 401/266

FOREIGN PATENT DOCUMENTS

| | | |
|---|---|---|
| GB | 2 020 174 A | 11/1979 |
| GB | 2 362 354 A | 11/2001 |
| JP | 61-19567 | 2/1986 |
| WO | WO 2008/061041 A2 | 5/2008 |

OTHER PUBLICATIONS

Form PCT/ISA/210 International Search Report issued in PCT/EP2012/056715 with mailing date of Jul. 23, 2012 with English translation (6 pages).
Office Action of German Patent Office issued in German Application No. 10 2011 007 405.8 dated Feb. 8, 2012 (4 pages).
European Examination Report issued in Appln. No. 12 716 335.0 dated Apr. 19, 2016 (6 pages).

* cited by examiner

COSMETIC DISPENSER

FIELD OF APPLICATION AND PRIOR ART

The invention relates to a pen-type cosmetic dispenser. Such a cosmetic dispenser comprises a housing extending in a main direction of extent and a discharge opening at an end face of the housing. Furthermore, such a dispenser possesses a liquid reservoir arranged inside the housing and a pumping device, which pumping device can be actuated by means of an actuating handle arranged on a lateral surface of the housing and has a pump chamber, which is connected to the liquid reservoir on an inlet side and to the discharge opening on an outlet side.

Such a cosmetic dispenser has a particular outer shape as a prominent feature. The outer shape has the shape of a pen, thus, in relation to length and diameter, is correspondent approximately to the dimensions of a conventional fountain pen or the like. This type of cosmetic dispenser, matched to a pen in view of the outer shape design thereof, has a particular role among cosmetic dispensers, as dispensers of such type are particularly handy to transport, and can be stored in particular even at those places in which pens are conventionally stored. More important, however, they allow a particular high accuracy during application of the cosmetic medium, when guided manually similar to a pen. Such media applied by means of such a dispenser may include covering (concealer, foundation) media, lip gloss or eyeshadow liquids, for example. They may also be used for an eyeliner.

Such dispenser devices are known in the prior art. In U.S. Pat. No. 6,200,055 a dispenser in the form of a pen is disclosed, for example, wherein a pivotable handle is provided on a lateral surface of the housing. The handle acts on a spring-biased piston via a sloped surface and displaces said piston upon actuation. Thereby, a discharge of liquid is caused.

Indeed, such a configuration is satisfactory in view of handling. However, large manufacturing efforts and high production costs are involved. In particular for disposable products, such a complex design is a disadvantage. Also, the required mechanical system can hardly be scaled down sufficiently to provide a slender and thus elegant dispenser.

OBJECT AND SOLUTION

An object of the invention is to further develop such a cosmetic dispenser in a pen shape to provide a dispenser combining the requirements of small outer dimensions, high metering accuracy, and low production costs.

According to the invention, the object is achieved by a cosmetic dispenser of the aforementioned type in the form of a pen, the pump chamber thereof being delimited at least in sections by a wall that is flexible in shape, wherein the exterior surface of the wall forms the actuating handle.

According to the invention, what is provided is that the pump chamber, which is delimited preferably on both sides by valves towards the liquid reservoir and the discharge opening, is variable in view of the internal volume thereof in that the chamber is delimited at least in sections by a wall which is flexible in shape, said wall being flexibly and elastically deformable in order to reduce the pump chamber volume. The deforming is enabled in that the exterior surface of the flexible wall as such forms the actuating handle, and thus is immediately accessible for a user. A wall is meant to be flexible in shape with an elastic modulus (Young's modulus) smaller than 0.5 $kN/mm^2$, preferably smaller than 0.25 $kN/mm^2$.

The features of the dispenser according to the invention are to be understood as follows. The cosmetic dispenser according to the invention has the shape of a pen. This means that it has a length of at least 90 mm in the direction of the main direction of extent thereof. Preferably, said length is even longer and is at least 100 mm, and a particularly preferred length is at least 120 mm. The maximum diameter of the cosmetic dispenser is 18 mm, however, preferably less, in particular less than 14 mm. The ratio of length to maximum diameter is preferably between 14:1 and 8:1.

These dimensions and relations allow handling similar to the handling of a pen intended for writing. The cosmetic dispenser can be guided using thumb and index finger, while resting in the crook between thumb and index finger. This allows a very accurate guiding of the discharge opening of the dispenser, and said feature is of great importance depending on the type of the cosmetic medium.

On a lateral surface of the cosmetic dispenser the actuating handle is provided, which actuating handle is formed by the exterior surface of the flexible wall delimiting the pump chamber with its interior surface. The pump chamber as a main component of the pumping device is provided separate from a liquid reservoir for accommodation of the cosmetic medium and connected thereto via a duct which preferably has an inlet valve. Reducing the volume of the pump chamber for the purpose of discharging medium is effected by means of deforming the actuating handle, that is, by pushing the actuating handle in the direction of a central axis of the cosmetic dispenser. According to the intended use, it is in particular provided that the actuating handle is operated using the index finger. Thus, it is spaced from the discharge opening at least in sections, preferably between 20 mm and 40 mm. This is correspondent to the conventional position of the index finger when guiding a pen.

Due to the very simple structural design of the cosmetic dispenser according to the invention, manufacturing is particularly cost-efficient. Furthermore, the pumping device including a pump chamber variable in volume by means of the actuating handle is particularly suitable to allow for a small structural design of the cosmetic dispenser, in particular in view of a particularly slender shape of the dispenser.

Generally, there is an option to delimit the pump chamber by said flexible wall merely in a narrow restricted partial section, which constitutes the actuating handle. In such a configuration, the chamber would preferably be delimited by rigid housing parts over the remaining circumference. However, advantageous is a configuration, wherein the flexible in shape wall surrounds the pump chamber circumferentially and has openings only on the inlet side and the outlet side. Thus, with such a configuration, the wall surrounding the pump chamber is manufactured completely of the same elastic material that is used for the actuating handle. Thus, the wall of the pump chamber is comparable to a tubular hose that is open merely on the inlet side and the outlet side. Due to this configuration, some problems in regard to sealing of the pump chamber are overcome.

Preferably, there are valves, in particular pressure relief valves, provided on the inlet side and the outlet side, wherein on the outlet side, a valve opening in case of an overpressure in the pump chamber may be provided, and wherein on the inlet side, a valve opening in case of a negative pressure in the pump chamber may be provided.

When the flexible in shape wall completely surrounds the pump chamber, said feature permits the design of a cosmetic dispenser according to the invention in such a manner that the housing section comprising the outlet opening is movable relative to the respective housing section surrounding the liquid reservoir due to the shape flexibility of the pump chamber wall. However, preferably those housing sections of the housing that in relation to the main direction of extent are provided on both sides of the actuating handle, and thus on the one hand define the outlet opening and on the other hand delimit the liquid reservoir, are rigid housing sections and interconnected by a likewise rigid connector section.

In the context of the present invention, a housing section is considered to be rigid, if the elastic modulus (Young's modulus) thereof is greater than 0.5 $kN/mm^2$, in particular greater than 1.0 $kN/mm^2$. What is obtained by using such a rigid connector section is that the cosmetic dispenser exhibits, with the exception of the actuating handle, a largely invariable exterior shape. This is advantageous for application of liquid precisely on the spot.

Preferably, the connector section provides a counterforce surface, arranged in the circumferential direction on the side of the housing opposite to the actuating handle. The counterforce surface facilitates dosed application of force to the actuating handle, since the cosmetic dispenser can be supported by means of a finger, in particular by means of the thumb, immediately opposite to the actuating handle provided on the lateral surface. Thus, during use of the dispenser, preferably, a thumb of a user rests on the counterforce surface, while the actuating handle is pushed in by means of the index finger of the user.

In the simplest case, the connector section is arranged as a simple web, and the pump chamber, surrounded by the flexible wall in the type of a hose, is pushed against it. However, a more resistant and therefore advantageous configuration provides that the rigid connector section circumferentially surrounds the preferably hose-type flexible wall and has a recess through which the actuating handle can be operated. In the case of a configuration of the flexible wall as a hose-type wall, the hose is arranged within a sleeve constituted by the rigid connector section, which preferably takes a larger part of the lateral surface of the dispenser than the actuating handle per se. For operating the actuating handle, merely the recess is provided and allows reaching of the flexible in shape wall constituting the actuating handle. With such a configuration, the portion of the flexible wall not accessible due to the connector section will not be deformed upon actuation, but is still understood to be part of the flexible wall in the sense of the present invention.

The connector section, in particular also in the configuration of a sleeve surrounding the flexible in shape wall, may be a separate component in which the flexible in shape wall is inserted in the course of assembly. A configuration has proved to be advantageous, wherein the flexible wall and the connector section are formed in an integral two-component injection molded part made of different materials. Thereby, assembly is facilitated and the risk of malfunction of the dispenser is reduced.

The above mentioned valves, separating the liquid reservoir and the pump chamber and the pump chamber and the discharge opening, respectively, from one another, may be valves including at least one separate component, in particular a valve body. However, a particularly advantageous embodiment provides that at least one of the valves is constituted by valve surfaces formed integral to the flexible wall. Thus, the flexible wall, which also is the actuating handle, adopts another function in that the outlet valve or the inlet valve of the pump chamber are formed thereby. Thus, separate components can partially be omitted. Particularly advantageous is a configuration, wherein the flexible wall has two lips which are touching upon balance of pressure on both sides of the valve, and which disengage upon overpressure or negative pressure in the pump chamber, and thus allow outflow or inflow of medium.

BRIEF DESCRIPTION OF THE DRAWINGS

Further advantages and aspects of the invention will become apparent from the claims and also from the following description of a preferred exemplary embodiment of the invention.

DETAILED DESCRIPTION OF THE EXEMPLARY EMBODIMENT

Figure 1:
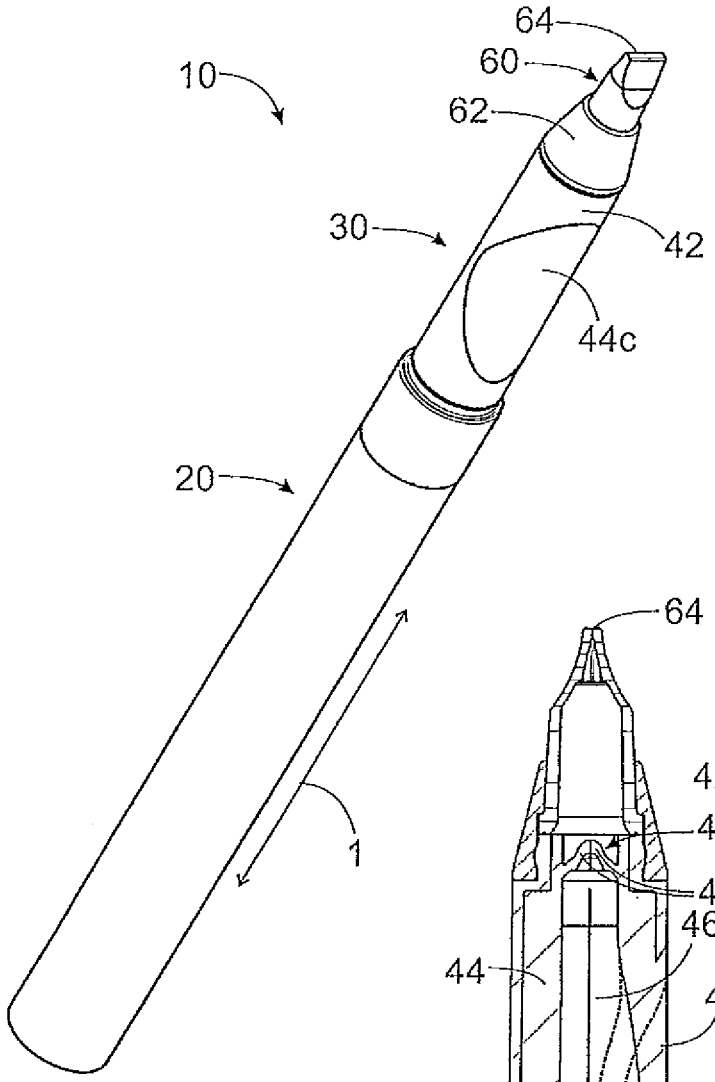
FIG. 1 illustrates a cosmetic dispenser according to the invention in an overall view.
Figure 2A:
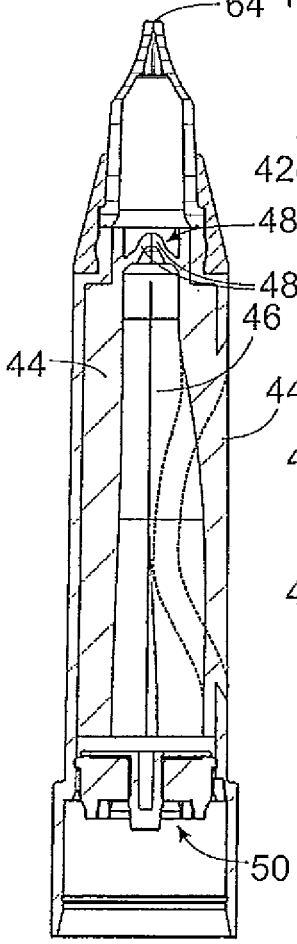
FIGS. 2*a* and 2*b* illustrate the pump and discharge unit of the dispenser of FIG. 1 in a sectional view and an exploded view.
Figure 2B:
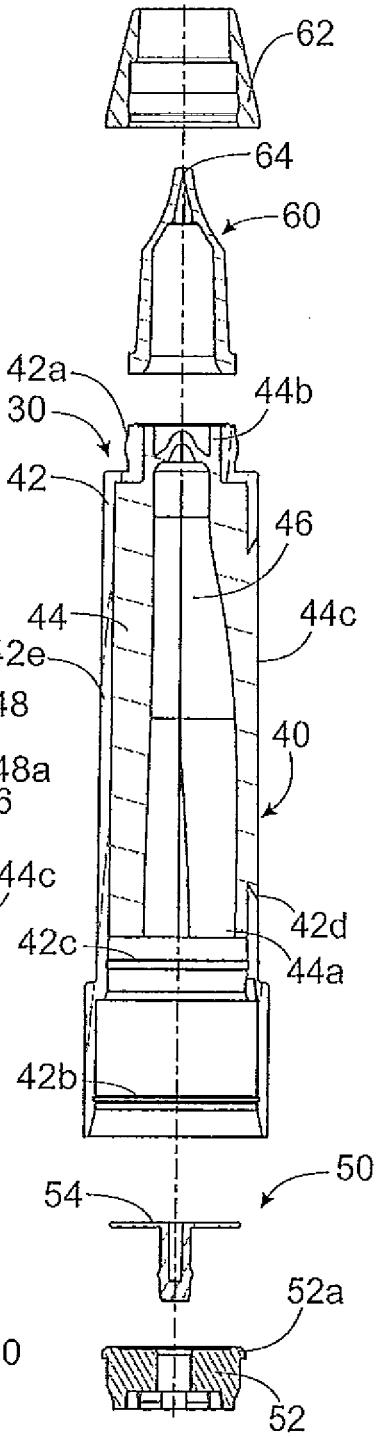

FIG. 1 shows a cosmetic dispenser according to the invention in an overall view. The cosmetic dispenser 10 has a pen-type, slender design. The length thereof is about 120 mm. The widest diameter thereof is about 12 mm. The major portion of the dispenser is made up by a liquid reservoir housing 20, comprising a hollow tubular housing section or housing component 22 and a follower piston 24 slidably displaceable therein, and surrounding a liquid reservoir 26. The liquid reservoir housing 20 is adjoined by a pumping and discharge unit 30, illustrated separately in FIGS. 2*a* and 2*b*. As is apparent in particular from FIG. 2*b*, the pumping and discharge unit 30 possesses a main body 40, an inlet valve unit 50, and a tip arrangement or housing component including an application tip 60 having a discharge opening 64 fixed on the main body 40 by means of a securing component 62 forming part of the tip arrangement. The main body 40 is composed of two partial components which are integrally connected in a two-component injection molded part. The outer one of said partial components is a housing sleeve or housing component 42 made of rigid synthetic material. The approximately sleeve-type partial component has a detent thickening 42*a* on the end facing the application tip for coupling to the securing component 62. On the opposite end facing the liquid reservoir 26 the partial component possesses, on the one hand, a detent device 42*b* for coupling the hollow tubular component 22 of the liquid reservoir 26. On the other hand, said partial component possesses a detent groove 42*c* facing inwards and serving for accommodation of the inlet valve unit 50.

The inlet valve unit 50 is composed of an insert 52 provided with through passages (not illustrated) arranged with a circumferential detent ring 52*a* for producing a detent engagement. An elastically deformable umbrella-shaped valve body 54 is latchable into said insert, which body closes the not illustrated through passages, until a deformation of the valve body 54 and thereby opening of the through passages occurs due to a negative pressure within the main component 40.

Inside the housing sleeve 42 a hose-type component or flexible wall 44 is inserted, which component is made of elastically deformable synthetic material and which is formed in one piece with the housing sleeve 42 in the above mentioned manner. The component 44 is open only at the end faces 44*a*, 44*b* thereof, wherein the end face 44*a* is oriented in the direction of the inlet valve 50, and wherein the end face 44*b* is oriented in the direction of the applicator tip 60. The hose-type body 44 surrounds a pump chamber 46. For the purpose of pumping liquid by means of said pump chamber 46, the internal volume of the pump chamber 46 can be reduced. For that purpose, a recess 42*d* is provided in the sleeve body 42 through which the elastically deformable hose-type body 44 can be deformed in the manner as indicated in FIG. 2 in dashed lines. The exterior surface 44*c* of the body 44, which can be reached through the recess 42*d*, constitutes the actuating handle of the dispenser 10.

On the output side of the pump chamber 46 facing the application tip 60, an outlet valve 48 is provided, which is formed by two valve lips 48*a*, which valve lips are formed as an integral part of the hose body 44, wherein the valve lips 48*a* are touching to close the pump chamber 46, until they are separated due to an overpressure in the pump chamber 46, and thereby release the liquid from the pump chamber 46 to the application tip 60 and thus to the discharge opening 64.

Figure 3:
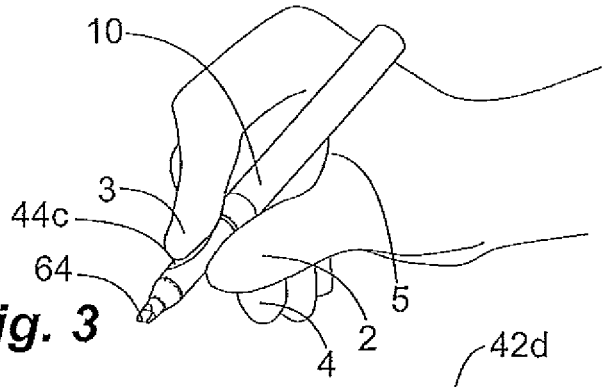
FIG. 3 illustrates the intended manipulation of the dispenser of FIGS. 1 and 2.

FIG. 3 shows manipulation of the dispenser 10 according to the invention. The dispenser is held in the same way as a pen, whereby it is guided by index finger 3, thumb 2 and middle finger 4. Thus, the pen rests in the crook 5 between thumb 2 and index finger 3. This way of holding ensures that the discharge opening 64 can be guided steadily, so that precise discharge on the spot of the cosmetic medium is allowed. As clearly visible in FIG. 3, the position of the actuating handle 44*c* is selected such that the handle can be operated conveniently using the index finger, while the pen is supported by the thumb 2 and middle finger 4.

Figure 4A:
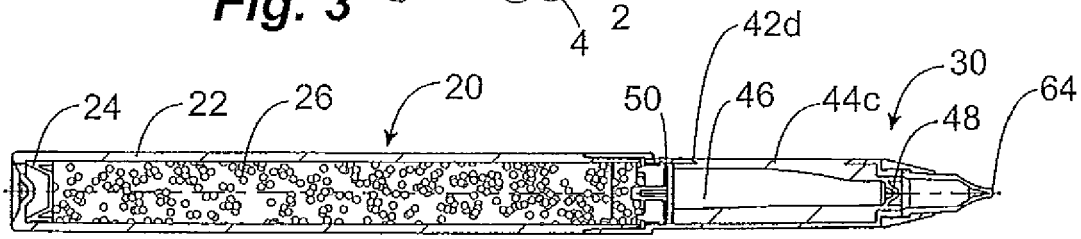
FIGS. 4*a* to 4*e* illustrate the operation of the dispenser of FIGS. 1 to 3.
Figure 4B:
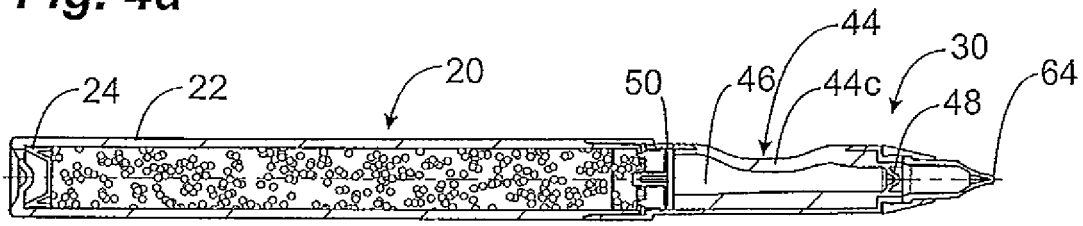
Figure 4C:
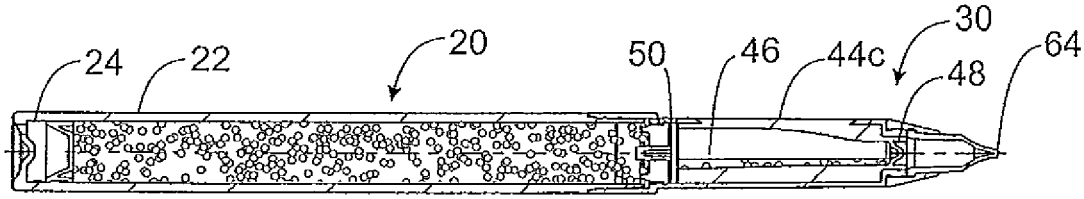

The functional operation of the dispenser is illustrated with reference to FIGS. 4*a* to 4*e*. FIG. 4*a* shows a dispenser in a condition as delivered, wherein the pump chamber 46 is still empty. For use of the dispenser, the latter is grasped in the manner as described above so that the index finger 3 rests on the actuating handle 44*c*. For initial operation of the dispenser 10, liquid has to be supplied to the pump chamber 46 at first. Therefore, the actuating handle 44*c* is pushed through the opening 42*d* in the manner as explained in FIG. 4*b* so that the volume of the pump chamber 46 is reduced. Thereby, the outlet valve 48 is opened so that part of the air flows out of the pump chamber 46. Upon releasing the actuating handle 44*c*, the hose-type body 44 relaxes and thereby produces a negative pressure within the pump chamber 46. The result is closing of the outlet valve 48 and opening of the inlet valve 50, whereby liquid is drawn from the liquid reservoir 26 into the pump chamber 46. Simultaneously, there is displacement of the follower piston 24. The condition obtained thereby is illustrated in FIG. 4*c*. Upon multiple repetitions of such an initial actuation, the pump chamber 46 is gradually filled with liquid.

Figure 4D:
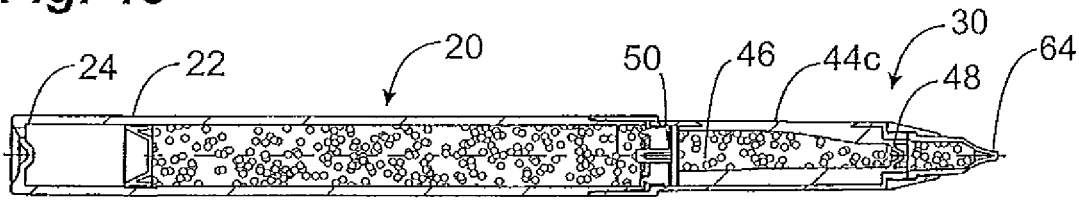
Figure 4E:
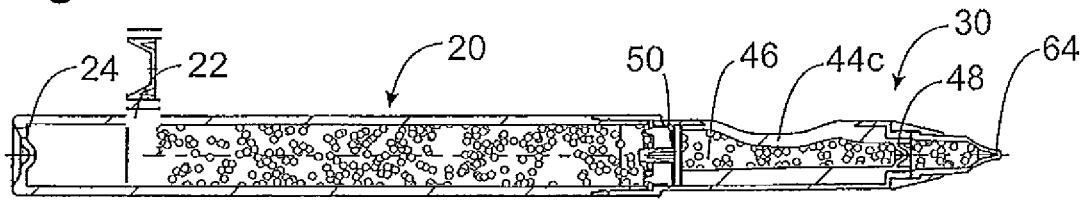

FIG. 4*d* shows a condition of the dispenser 10, wherein said dispenser has the pump chamber 46 already completely filled with liquid. When based on this condition the actuating handle 44*c* is pushed in by the index finger, with closed inlet valve 50, the corresponding amount of liquid is discharged through the discharge opening 64. The directness between the volume reduction of the pump chamber 46 and the liquid discharge provides a simple option to allow very precise discharge of liquid through the discharge opening 46, wherein, due to the pen-type handling of the dispenser 10, not only exactly the desired amount can be discharged, but even on the desired spot, in particular the desired area of skin, in a quite simple manner.

The invention claimed is:

1. A cosmetic dispenser in the form of a pen for discharging a cosmetic medium, said cosmetic dispenser comprising:

a housing elongated along a main direction of extent and having an end face including a discharge opening;

a liquid reservoir disposed within an interior of said housing and filled with a liquid cosmetic;

a pumping device disposed within said interior of said housing, said pumping device including a pump chamber connected to said liquid reservoir on an inlet side of said pump chamber and to said discharge opening on an outlet side of said pump chamber;

a flexible wall disposed in circumferentially surrounding relation with said pump chamber, said flexible wall having openings only at said inlet and outlet sides of said pump chamber, said flexible wall having an exterior surface disposed on a lateral surface of said housing and forming an actuating portion of said pumping device; and a valve disposed between said discharge opening and said pump chamber, said valve including two valve lips formed as one-piece with said flexible wall, said valve lips having respective surfaces disposed in opposed relation and in direct contact with one another to define a closed position of said valve, said valve lips being movable away from one another and out of contact with one another to define an open position of said valve which permits communication between said pump chamber and said discharge opening to dispense a predetermined amount of liquid cosmetic through said discharge opening;

said housing including first and second rigid housing components disposed, along the main direction of extent, on respective opposite sides of said actuating portion, and a third rigid housing component interconnecting said first and second rigid housing components to one another, said third rigid housing component including a counterforce surface disposed, in a circumferential direction of said housing, substantially opposite said actuating portion to permit application of a force to said actuating portion with one finger and application of a counterforce to said counterforce surface with another finger, said third rigid housing component being disposed in circumferentially surrounding relation with said flexible wall and defining an opening through which said actuating portion is accessible, said flexible wall and said third rigid housing component being formed as an integral two-component injection-molded part.

2. The cosmetic dispenser of claim 1, wherein said pump chamber is filled with liquid and said actuating portion is movable inwardly to pressurize said pump chamber and reduce a volume thereof and cause the predetermined amount of liquid cosmetic to be dispensed from said pump chamber through said discharge opening.

3. The cosmetic dispenser of claim 1, wherein said valve is disposed between said discharge opening and said pump chamber at said outlet side thereof.

4. The cosmetic dispenser of claim 3, wherein said valve is an outlet valve and said cosmetic dispenser further includes an inlet valve disposed between said liquid reservoir and said pump chamber at said inlet side thereof, wherein said pump chamber is filled with liquid cosmetic and said inlet valve is closed and said actuating portion is movable inwardly to open said outlet valve and dispense liquid cosmetic through said discharge opening.

5. The cosmetic dispenser of claim 1, wherein said flexible wall is cylindrical in shape and said opening of said flexible wall at said outlet side of said pump chamber is defined between the respective surfaces of said valve lips in said open position of said valve.

6. The cosmetic dispenser of claim 1, wherein said valve lips are disposed to close off said pump chamber at said outlet side thereof and control the flow of liquid cosmetic between said pump chamber and said discharge opening, said valve lips extending inwardly so as to terminate at the respective said surfaces, said surfaces being disposed in direct abutting contact with one another in said closed position of said valve, and said actuating portion is movable inwardly to pressurize said pump chamber and move said surfaces of said valve lips out of contact with one another and into said open position of said valve to dispense the predetermined amount of liquid cosmetic from said pump chamber through said discharge opening.

7. The cosmetic dispenser of claim 1, wherein said flexible wall has an inner surface facing away from said exterior surface, and an entire circumferential extent of said pump chamber is defined solely by said inner surface of said flexible wall.

8. A cosmetic dispenser comprising:

an elongate housing having a hollow interior and defining a longitudinal axis, said housing having a first end including a discharge opening and a second end remote from said first end;

a reservoir disposed within said interior of said housing and configured to store a liquid cosmetic therein;

a pump including a pump chamber having an inlet in fluid communication with said reservoir and an outlet in fluid communication with said discharge opening;

said housing including a substantially tubular and flexible housing wall extending along the axis and defining said pump chamber, said flexible housing wall having an actuator portion including a surface disposed externally along said housing, said actuator portion being movable inwardly in a direction towards the axis to actuate said pump; and a valve formed in one-piece with said flexible housing wall and being disposed to close off said pump chamber at said outlet thereof and control the flow of liquid cosmetic between said pump chamber and said discharge opening, said valve including first and second valve lips formed in one-piece with said flexible housing wall, said first and second valve lips extending inwardly towards the axis and terminating at respective opposed surfaces disposed in direct abutting contact with one another in a closed position of said valve, said actuator portion being movable inwardly to pressurize said pump chamber and move said surfaces of said valve lips out of contact with one another and into an open position of said valve to dispense a predetermined amount of liquid cosmetic from said pump chamber through said discharge opening.

9. The cosmetic dispenser of claim 8, wherein said housing includes a substantially tubular and rigid housing wall disposed in surrounding relation with said flexible housing wall, said rigid housing wall defining an opening in which said actuator portion is disposed.

10. The cosmetic dispenser of claim 9, wherein said flexible housing wall has an inner surface facing away from said surface of said actuator portion, and an entire circumferential extent of said pump chamber is defined solely by said inner surface of said flexible housing wall.

11. The cosmetic dispenser of claim 8, wherein said flexible housing wall has an inner surface facing away from said surface of actuator portion, and an entire circumferential extent of said pump chamber is defined solely by said inner surface of said flexible housing wall.

12. The cosmetic dispenser of claim 8, wherein said cosmetic dispenser has an overall length of at least 120 mm and a maximum diameter of 18 mm to provide said cosmetic dispenser with a pen-shape such that said cosmetic dispenser is guidable by a user's index, thumb and middle fingers to permit discharge of liquid cosmetic from said discharge opening at a precise location and when said pump chamber is filled with liquid cosmetic and said actuator portion is actuated said valve opens and a predetermined amount of liquid cosmetic is dispensed from said pump chamber through said discharge opening.

13. The cosmetic dispenser of claim 9, wherein said rigid housing wall includes a counterforce surface disposed substantially diametrically opposite said actuator portion to permit application of a force to said actuator portion with one finger and application of a counterforce to said counterforce surface with another finger, said cosmetic dispenser having an overall length of at least 120 mm and a maximum diameter of 18 mm to provide said cosmetic dispenser with a pen-shape such that said cosmetic dispenser is guidable by a user's fingers to permit discharge of liquid cosmetic from said discharge opening at a precise location.

14. The cosmetic dispenser of claim 8, wherein said actuator portion is movable inwardly to pressurize said pump chamber and reduce a volume thereof and cause the predetermined amount of liquid cosmetic to be dispensed from said pump chamber through said discharge opening.

15. The cosmetic dispenser of claim 8, wherein said valve is an outlet valve disposed adjacent said discharge opening and said cosmetic dispenser comprises an inlet valve disposed to close off said pump chamber at said inlet thereof and control the flow of liquid cosmetic between said reservoir and said pump chamber, said inlet valve opening when a negative pressure is present within said pump chamber to permit flow of liquid cosmetic from said reservoir to said pump chamber.

16. The cosmetic dispenser of claim 1, wherein said cosmetic dispenser has an overall length of at least 120 mm and a maximum diameter of 18 mm to provide said cosmetic dispenser with a pen-shape such that said cosmetic dispenser is guidable by a user's index, thumb and middle fingers to permit discharge of liquid cosmetic from said discharge opening at a precise location.

17. A cosmetic dispenser in the form of a pen for discharging a cosmetic medium, said cosmetic dispenser comprising:

a housing elongated along a main direction of extent and having an end face including a discharge opening;

a liquid reservoir disposed within an interior of said housing and filled with a liquid cosmetic;

a pumping device disposed within said interior of said housing, said pumping device including a pump chamber connected to said liquid reservoir on an inlet side of said pump chamber and to said discharge opening on an outlet side of said pump chamber;

a flexible wall disposed in circumferentially surrounding relation with said pump chamber, said flexible wall having openings only at said inlet and outlet sides of said pump chamber, said flexible wall having an exterior surface disposed on a lateral surface of said housing and forming an actuating portion of said pumping device, said flexible wall having an inner surface facing away from said exterior surface, and an entire circumferential extent of said pump chamber is defined solely by said inner surface of said flexible wall; and a valve disposed between said discharge opening and said pump chamber, said valve including two valve lips formed as one-piece with said flexible wall, said valve lips having respective surfaces disposed in opposed relation and in direct contact with one another to define a closed position of said valve, said valve lips being movable away from one another and out of contact with one another to define an open position of said valve;

said housing including first and second rigid housing components disposed, along the main direction of extent, on respective opposite sides of said actuating portion, and a third rigid housing component interconnecting said first and second rigid housing components to one another, said first housing component defining therein said liquid reservoir and said second housing component including a tip part defining said discharge opening therein and an annular securing element disposed in surrounding relation with said tip part, said third housing component coupling with said securing element to interconnect said first and second housing components to one another, said third rigid housing component including a counterforce surface disposed, in a circumferential direction of said housing, substantially opposite said actuating portion to permit application of a force to said actuating portion with one finger and application of a counterforce to said counterforce surface with another finger, said third rigid housing component being disposed in circumferentially surrounding relation with said flexible wall and defining an opening through which said actuating portion is accessible, said flexible wall and said third rigid housing component being formed as an integral two-component injection-molded part and being separate from said tip part;

said cosmetic dispenser having an overall length of at least 120 mm and a maximum diameter of 18 mm to provide said cosmetic dispenser with a pen-shape such that said cosmetic dispenser is configured for being guided by a user's index, thumb and middle fingers to permit discharge of liquid cosmetic from said discharge opening at a precise location on a user's skin, and when said pump chamber is filled with liquid cosmetic and said actuating portion is actuated by a user, said valve opens and a predetermined amount of liquid cosmetic is dispensed from said pump chamber, into said tip part and through said discharge opening.

* * * * *